United States Patent [19]

Taylor

[11] Patent Number: 4,976,302

[45] Date of Patent: Dec. 11, 1990

[54] APPARATUS FOR OPENING AND CLOSING ROLL-UP DOOR

[75] Inventor: Douglas B. Taylor, Barrie, Canada

[73] Assignee: M & I Door Systems Limited, Barrie, Ontario, Canada

[21] Appl. No.: 280,680

[22] Filed: Dec. 6, 1988

[30] Foreign Application Priority Data

Dec. 18, 1987 [CA] Canada ..... 554847

[51] Int. Cl.[5] ..... E06B 9/20

[52] U.S. Cl. ..... 160/310; 160/321

[58] Field of Search ..... 160/310, 277, 321, 265, 160/133

[56] References Cited

U.S. PATENT DOCUMENTS

| | | | |
|---|---|---|---|
| 1,936,300 | 11/1933 | Guss | 186/46 |
| 2,738,179 | 3/1956 | Joy | 262/34 |
| 2,819,628 | 1/1958 | Wardlaw | 74/625 |
| 2,957,521 | 10/1960 | Greegor | 160/133 |
| 3,522,834 | 8/1970 | Corcoran | 160/133 X |
| 3,637,004 | 1/1972 | Wardlaw et al. | 160/133 |
| 3,680,622 | 8/1972 | Lester, Jr. | 160/310 X |
| 3,853,167 | 12/1974 | Wardlaw | 160/133 |
| 3,989,084 | 11/1976 | Inamura et al. | 160/36 |
| 4,478,268 | 10/1984 | Palmer | 160/310 |
| 4,690,195 | 9/1987 | Taylor | 160/310 |

FOREIGN PATENT DOCUMENTS 0117116 8/1984 European Pat. Off. .

*Primary Examiner*—Blair M. Johnson
*Attorney, Agent, or Firm*—Krass & Young

[57] ABSTRACT

A rolling door mechanism employing an idler drive member freely supported about an idler roll of a roll door assembly. An adjusting element, for example, a coiled spring which surrounds the idler roll, accommodates differences in speed of the idler drive member and the idler roll. The adjusting element is connected at one end for rotation with the idler drive member and at the other end for rotation with the idler roll. In one preferred embodiment the coiled spring is tensioned during rotation of the idler drive member in one direction by drive means and this tension is released during rotation of the idler drive member in the opposite direction.

10 Claims, 5 Drawing Sheets

FIG.1.
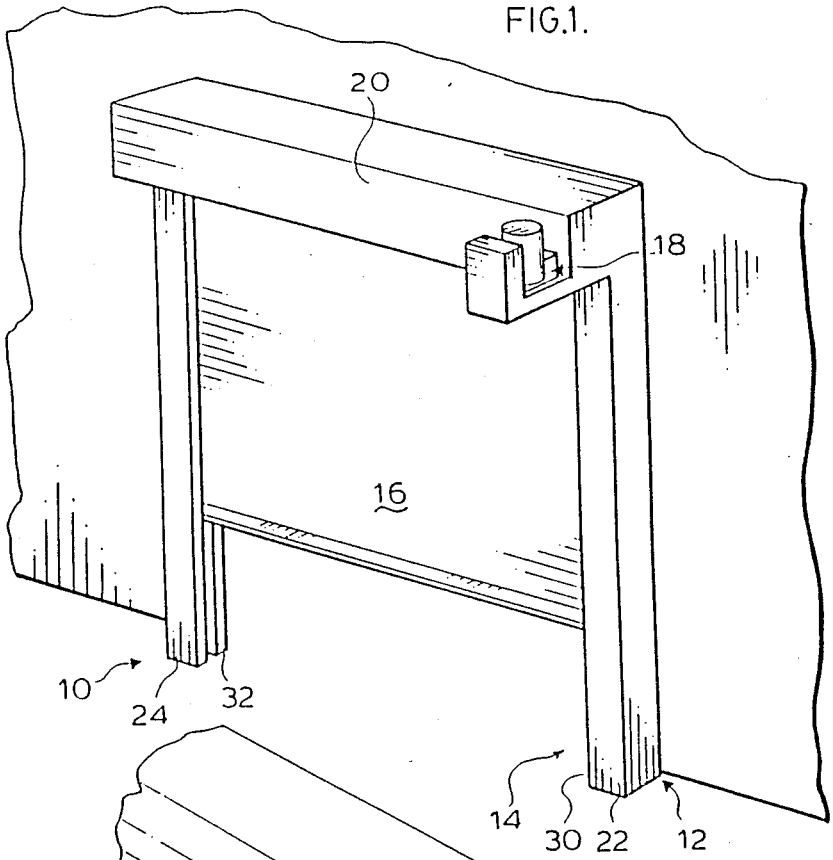
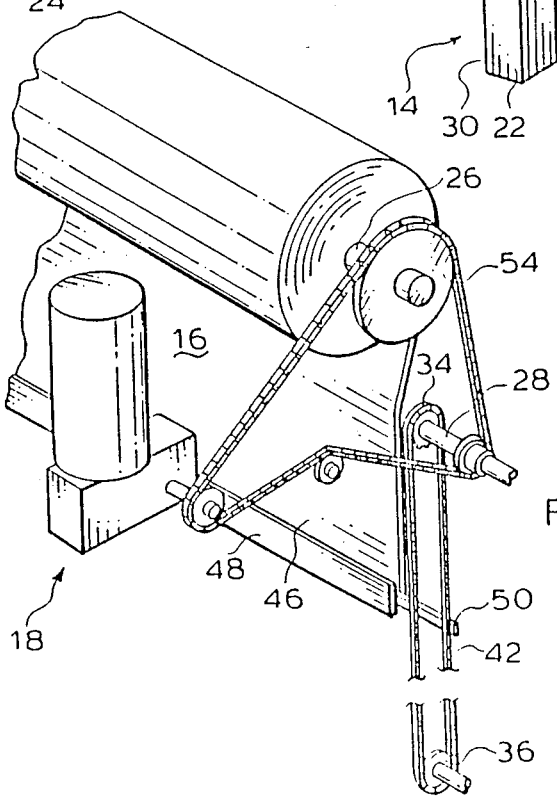
FIG.3.

APPARATUS FOR OPENING AND CLOSING ROLL-UP DOOR

BACKGROUND OF THE INVENTION

This invention relates to rolling doors and in particular an operating mechanism for opening and closing a rolling door.

The use of rolling doors, particularly for industrial applications and for mining, is well known. These doors can be of various constructions including flexible doors made from rubber or plastic sheets. The door is rolled up about a horizontal shaft extending across the top of the door opening. There can be a spring loaded barrel arranged on the shaft about which the door is rolled. The purpose of this barrel is to overcome the gravitational forces acting on the door so that the door will open with relative ease. It is common to provide an electric operator including an electric motor to open and close the door. Vertical guideways are generally provided along the sides of the doorway to accommodate the edges of the flexible door.

U.S Pat. No. 4,690,195, D. B. Taylor, issued Sept. 1, 1987, teaches operating mechanisms for a rolling door having a power operated means for roll up of the roll door to open the door opening and a power operated means for rolling down the door to close the door opening.

In one embodiment taught in the aforementioned U.S. Patent the drive gear for the door shaft which supports the roll door and the drive gear for the idler shaft are floatingly mounted on such shafts for free rotation; a dog member is mounted for rotation with each of the door and idler shafts and a dog engaging pin is mounted on each of the drive gears. The pin and dog member associated with the drive shaft and idler shaft, respectively, interact for positive rotary drive of the drive shaft or idler shaft, as required. This arrangement accommodates excess winding and unwinding forces which develop at the idler gear as a result of variation in the actual linear velocity of travel of the unwound end portion of the roll door during winding and unwinding; the variation in linear velocity arises from the variation in the diameter of the windings of the rolled door on the door shaft as it is rotated, and the constant speed of rotation of the drive and idler shafts.

The aforementioned arrangement requires precise relative location of the dog member and pin associated with each shaft to ensure that engagement and positive drive only occurs at appropriate configurations relative to the wound end position of the roll door.

It is an object of the present invention to provide a simpler arrangement and structure of operating mechanism.

SUMMARY OF THE INVENTION

In accordance with the invention an idler drive member is supported about the idler or guide roll of a roll door assembly; an adjusting element capable of accommodating differences in turning forces developed at the idler drive member and at the idler or guide roll is connected between the idler drive member and the idler or guide roll.

The door roll of the assembly and the idler drive member are driven concurrently at the same speed of rotation and in the same direction by a common drive, and typically at a constant speed of rotation, whereas the idler or guide roll is driven by the vertical travel of an outer unwound end of the flexible curtain of the roll door assembly.

The linear velocity of travel of the outer unwound end of the curtain varies as the diameter of the windings of flexible curtain on the door shaft varies during winding and unwinding of the curtain. Thus the idler or guide roll rotates at a varying speed of rotation. The difference in the speeds of rotation of the idler drive member and the idler or guide roll and the difference in turning forces developed thereby is taken up by the adjusting element which thus functions as a turning force accommodating member.

In a particular embodiment the adjusting element comprises a coiled spring surrounding the idler or guide roll and having one end connected for rotation with the idler or guide roll and the other end connected for rotation with the idler drive member. Such coiled spring may be considered to contract or expand depending on whether the curtain is being wound or unwound.

Thus in one aspect the invention provides a rolling door mechanism and in another provides a rolling door assembly incorporating a rolling door mechanism.

The invention s illustrated in a particular and preferred embodiment by reference to the accompanying drawings.

BRIEF DESCRIPTION OF THE DRAWINGS

FIG. 1 is a front elevation of a roll door assembly in accordance with the invention;

FIG. 3 is a schematic side elevation;

DETAILED DESCRIPTION OF PREFERRED EMBODIMENT

Figure 2:
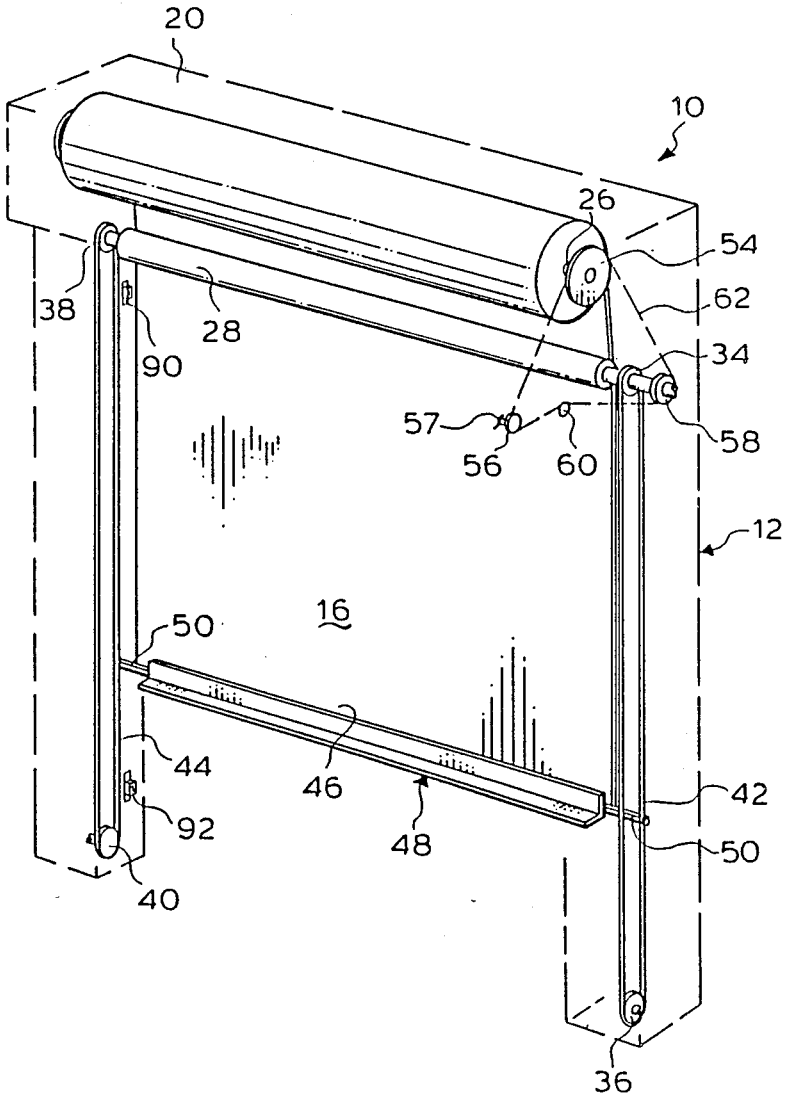
FIG. 2 is a view similar to FIG. 1 illustrating schematically features of the operating mechanism.

With further reference to FIGS. 1, 2 and 3, a roll door assembly 10 includes a door frame 12 mounted about a door opening 14.

Roll door assembly 10 includes a flexible roll door or curtain 16 and an operating mechanism 18 which functions to wind and unwind the curtain 16 to open and close door opening 14. Curtain 16 is preferably constructed from a flexible sheet material, for example, rubber, particularly synthetic rubber. The sheet material should preferably be resilient and able to withstand collision forces as when a vehicle unintentionally hits curtain 16 when closed.

Door frame 12 includes a horizontal element 20 and a pair of spaced apart vertical elements 22 and 24. Horizontal element 20 is disposed adjacent the upper end of door opening 14 and vertical elements 22 and 24 are disposed adjacent the opposed sides of door opening 14.

A rotatable door shaft 26 is mounted at the upper end of door frame 12 so as to extend horizontally across upper end of door opening 14. Door shaft 26 may in particular be in the form of a spring loaded drum or barrel, a typical structure is described in U.S. Pat. No. 4,478,268, G. R. Palmer, issued Oct. 23, 1984. Briefly torsion springs are associated within the drum or barrel at the ends thereof, these springs assist in the winding of the curtain and also counterbalance the weight of the curtain during winding and unwinding.

Idler shaft 28 is similarly rotatably mounted in an upper end of door frame 12 so as to extend horizontally across door opening 14; idler shaft 28 being disposed in generally parallel spaced apart relationship with door shaft 26, and being disposed somewhat below door shaft 26.

Guide channels 30 and 32 are defined in vertical elements 22 and 24 respectively.

An upper sprocket 34 is mounted in guide channel 30 on idler shaft 28 and a lower sprocket 36 is mounted in a lower region of guide channel 30 in opposed relationship with upper sprocket 34.

Similarly an upper sprocket 38 is mounted in guide channel 32 on idler shaft 28 and a lower sprocket 40 is mounted in a lower region of guide channel 32 in opposed relationship with upper sprocket 38.

An endless chain 42 extends about upper sprocket 34 and lower sprocket 36; and an endless chain 44 extends about upper sprocket 38 and lower sprocket 40.

Figure 4:
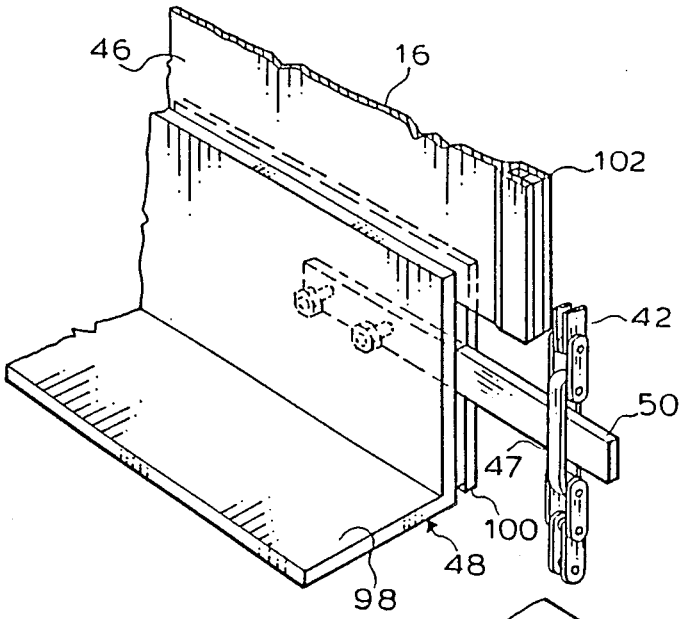
FIG. 4 is a perspective view of a detail illustrating the mounting of the outer end of the flexible roll door in the assembly of the invention.

Flexible curtain 16 is mounted at an inner end on door shaft 26. An outer unwound end 46 of curtain 16 terminates in a rigid end member 48. Chain engaging fingers 50 extend from opposed ends of rigid end member 48 and as more particularly shown in FIG. 4, are received within a chain loop 47 of endless chain 42 and a chain loop 49 of endless chain 44, respectively.

Idler shaft 28 is bearingly supported by bearings (not shown) mounted in support brackets (not shown) on frame 12.

With further reference to FIGS., 2, 3 and 5, the operating mechanism 18 includes a door sprocket 54, a drive sprocket 56, an idler sprocket 58, a chain tightener 60 and a drive chain 62 extending about sprockets 54, 56 and 58, and additionally being engaged by tightener 60 to accommodate any slack in chain 62.

Door sprocket 54 is fixedly keyed to door shaft 26 for rotation therewith. Idler sprocket 58 is floatingly mounted about idler shaft 28 for free rotation thereabout and relative thereto.

Figure 5:
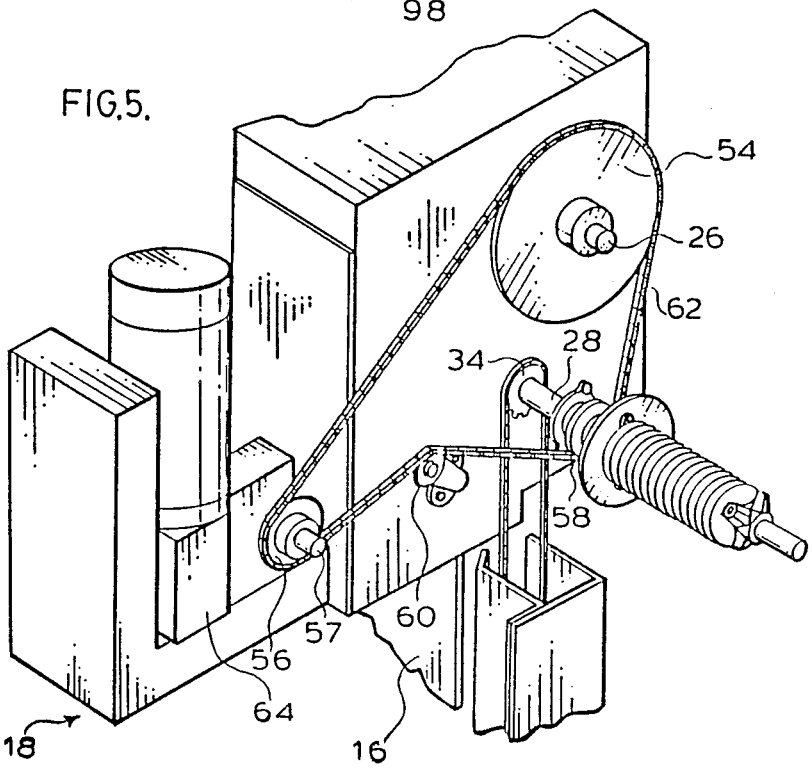
FIG. 5 is a perspective view of the operating mechanism.

As more particularly shown in FIG. 5, drive sprocket 56 includes a drive shaft 57 which is driven by a motor 64 by any convenient means, for example, a drive belt (not shown).

Upper sprockets 34 and 38 are keyed to idler shaft 28 for rotation therewith.

Figure 6:
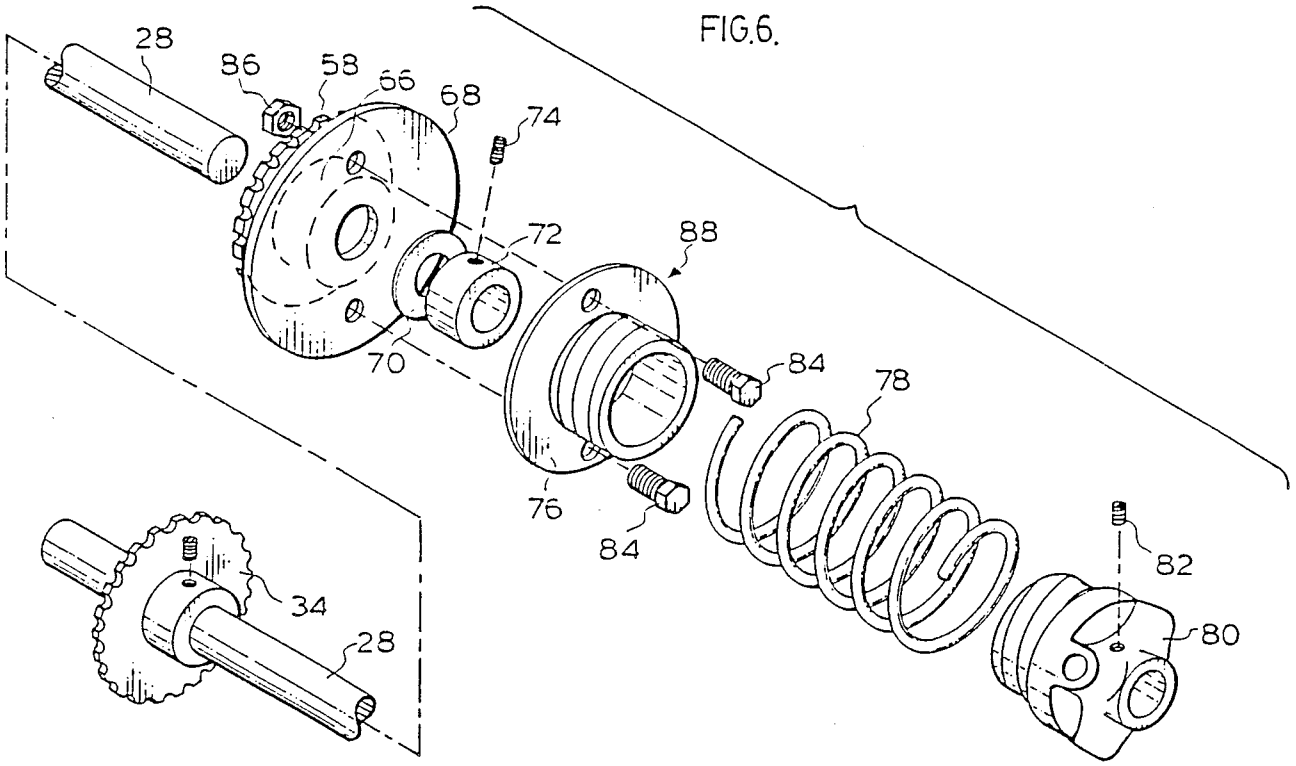
FIG. 6 is an exploded view of the spring assembly of the operating mechanism of FIG. 5; and FIGS. *7a* and *7b* are a schematic representation of the roll door in side elevation showing the roll door at the beginning of descent during unwinding and the beginning of ascent during winding.

With further reference to FIGS. 5 and 6, idler sprocket 58 includes a hub 66 to which is welded an annular disc 68.

A collar 72 is fixed by key 74 to idler shaft 28 for rotation therewith and a thrust washer 70 is mounted about idler shaft 28 between collar 72 and disc 68. The collar 72 serves to limit lateral outward movement of idler sprocket 58.

A spring member 88 includes an annular spring fitting 76, coiled spring 78, a spring mounting 80, mounting screw 82, mounting bolts 84 and mounting nuts 86.

Coil spring 78 is connected at one end to annular spring fitting 76 which in turn is bolted by mounting bolts 84 and nuts 86 to annular disc 68. The remote outer end of coil spring 78 is secured to spring mounting 80 which is secured to idler shaft 28 by means of mounting screw 82. Thus the outer end of spring member 88 is fixed to idler shaft 28 at spring mounting 80 for rotation therewith, and the body and inner end of coil spring 78 are effectively mounted to idler sprocket 58 and thus mounted for free rotation about idler shaft 28.

With further reference to FIG. 4, rigid end member 48 includes an angle member 98 and plate 100 which are bolted together sandwiching therebetween the chain engaging fingers 50 and the outer unwound end 46 of curtain 16.

Curtain 16 has thickened side edges 102 to facilitate retention in the guide channels 30 and 32.

Finally, and with further reference to FIG. 2, a top limit switch 90 and a bottom limit switch 92 serve to switch off motor 64 at the upper and lower extremities of the path of travel of curtain 16. The use and construction of such switches for rolling doors is well known in the art and a detailed description thereof is therefore unnecessary. The limit switches 90 and 92 are operated by a limit switch pin 94 connected to endless chain 42 at a location spaced a short distance above rigid end member 48.

Idler shaft 28 functions as a guide roll to guide the flexible sheet material of curtain 16 into, during descent of curtain 16, and out of, during ascent of curtain 16, the guide channels 32 and 34. This guidance is especially important in the case of a curtain 16 of rubber sheet material since there is a tendency for rubber to bind against metal, which is typically the material of fabrication of the guide channels 32 and 34, and this hinders free running of curtain 16.

The idler shaft is suitably mounted on that side of curtain 16 which is presented, in those applications where there is a pressure differential across curtain 16, to the lower pressure side. Under such conditions of pressure difference there is a tendency for curtain 16 to bow to the lower pressure side, and in such case the location of idler shaft 28 on such lower pressure side, and in contact with curtain 16, prevents such bowing and ensures that the curtain 16 runs properly in guide channels 32 and 34 without binding.

The thickened edges 102 serve to better retain the side edges of curtain 16 in the guide channels 32 and 34 and at the same time assist in sealing, particularly in high pressure applications. The thickened edges 102 are such that the curtain 16 may be dislodged from guide channels 32 and 34 in the event of force due to collisions, such dislodgement being preferable to curtain damage.

With further reference to FIG. *7a*, the curtain 16 is shown in the raised position in which unwinding has commenced to close door opening 14. FIG. *7b* shows curtain 16 in the closed position in which winding has commenced to open door opening 14.

Considering the closing of door opening 14 by curtain 16 and with reference to FIGS. 2, 5 and *7a*, motor 64 drives drive sprocket 56 through drive shaft 57 in a first direction thereby driving drive chain 62 to drive door sprocket 54 and door shaft 26 (counterclockwise as viewed in FIG. *7a*) so as to unwind curtain 16 whereby outer unwound end 46 of curtain 16 descends. In this configuration the windings 104 form a roll of flexible sheet material of curtain 16 of greatest diameter.

Figure 7A:
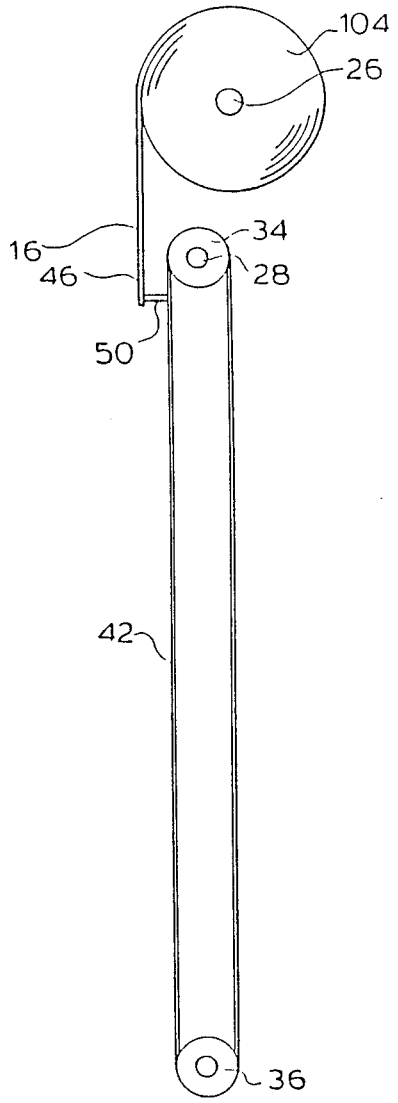

With the descent of outer unwound end 46, chain engaging fingers 50 drive endless chains 42 and 44, respectively, to rotate upper and lower sprockets 34, 36 and upper and lower sprockets 38, 40, respectively. Rotation of upper sprockets 34 and 38 causes a corresponding rotation (counterclockwise as viewed in FIG. 7*a*) of idler shaft 28 at a speed dictated by the linear velocity of outer unwound end 46.

The linear velocity of outer unwound end 46 decreases as end 46 descends. The reason for this is that drive sprocket 56 and hence door sprocket 54 and door shaft 26 rotate at a constant speed of revolution. Each complete revolution of door sprocket 54 results in an unwinding of one revolution of the windings 104 of the curtain 16 on door shaft 26. As the curtain 16 is unwound, the diameter of the windings 104 on door shaft 26 decreased, whereby each revolution of door shaft 26 during the unwinding results in release of a progressively shorter length of curtain 16, corresponding to the progressively reduced diameter of the windings 104.

Idler sprocket 58 is also driven by drive chain 62 and thus rotates at a constant speed of rotation corresponding to that of door sprocket 54. The coil spring 78 which is effectively connected between the idler sprocket 58 rotating at constant speed and upper sprocket 34 rotating at a variable speed corresponding to the variation in linear velocity of outer unwound end 46, accommodates the difference in rotating speeds between idler sprocket 58 and idler shaft 28.

As outer unwound end 46 descends with a decreasing linear velocity, so that upper sprocket 34 and idler shaft 28 rotate progressively more slowly, the rotating forces developed by the constant faster rotation of idler sprocket 58 serve to wind the coils of coil spring 78 and are thereby transferred into a form of stored energy, i.e., spring tension, in coiled spring 78. The spring tension which is progressively developed in coiled spring 78 itself urges upper sprocket 34 and idler shaft 28 to rotate thereby effecting a positive drive through fingers 50 on rigid end member 48, so as to positively pull curtain 16 downwardly.

Figure 7B:
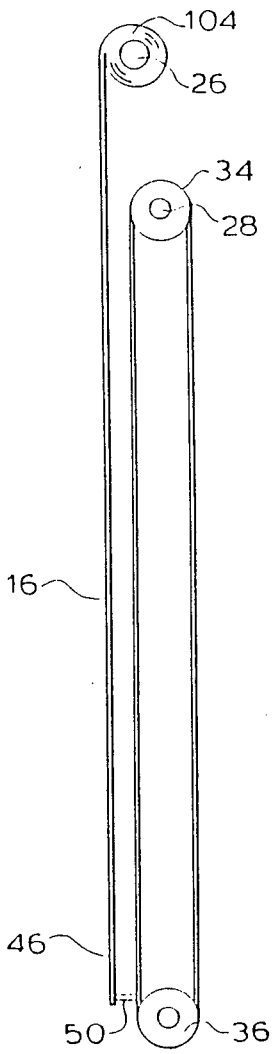

In the configuration illustrated in FIG. 7*b*, the curtain 16 is in the closed position but has commenced to rise, in this configuration the diameter of windings 104 is at a minimum. In this operation motor 64 drives drive sprocket 56 through drive shaft 57 in a second direction opposite to the first direction, clockwise as viewed in FIG. 7*b*, thereby driving chain 62 in such clockwise direction to similarly rotate drive sprocket 56 and with it door shaft 26 in a clockwise direction to roll up or wind up curtain 16 on door shaft 26. It will be recognized that with each successive length or winding of curtain 16 which is wound on to door shaft 26, the diameter of the windings 104 on door shaft 26 increases whereby the linear velocity of the outer unwound end 46 progressively increases, since with the increase in diameter of the windings a greater length of curtain 16 is wound on door shaft 26 for each complete rotation of door shaft 26.

Thus as the linear velocity of outer unwound end 46 progressively increases, the speed of rotation, this time clockwise rotation, of upper sprocket 34 and thus idler shaft 28 also increases. Drive chain 62 also drives idler sprocket 58 in clockwise direction, however, idler sprocket 58 is driven at a constant speed of rotation concurrently with door sprocket 54. The differences in the speed of rotation are again accommodated by coiled spring 78, the coils of which are unwound releasing energy during the ascent of curtain 16.

As described above with reference to FIG. 7*a* energy taken up by coiled spring 78 during descent of outer end 46 also functions to positively urge upper sprocket 34 and with it idler shaft 28 to rotate such that fingers 50 positively pull curtain 16 downwardly at outer end 46. This has the additional benefits of assisting motor 64 whereby a motor 64 of lower power may be employed and, by exerting a continuous downward pull on curtain 16 at outer end 46, assists in maintaining the descending curtain 16 taut thereby eliminating bowing or buckling which might otherwise interfere with the free running.

The stored energy in coiled spring 78 when curtain 16 is in the closed configuration of FIG. 7*b* is also exploited when curtain 16 ascends to open the door opening 14 as illustrated in FIG. 7*b*. In this case the stored energy in the coiled spring 78 assists motor 64 in raising curtain 16.

This stored energy in coiled spring 78 also serves to counterbalance the weight of curtain 16, which may be significant in the closed configuration of FIG. 7*b*. In some structures the need for torsion springs in the drum or barrel of door shaft 26 may be avoided.

Thus the present invention provides a relatively simple mechanism for driving the door and idler shafts of a roll door assembly, employing an endless drive chain, while avoiding the need for intermeshing gear wheels, and complex arrangements of dogs and pins as described in U.S. Pat. No. 4,690,196.

I therefore claim:

1. A roll door assembly comprising:

a flexible curtain having an inner end, an outer end and side edges, a curtain winding and unwinding mechanism, a rotatable curtain roll, said inner end of said curtain being mounted to said curtain roll, a pair of generally parallel, spaced apart guide channels, said side edges being received in said guide channels for travel therein, a rotatable guide roll adapted to guide said curtain during travel, relative to said guide channels, said curtain mechanism comprising a curtain sprocket mounted to said curtain roll, a guide sprocket supported about said guide roll and drive means to rotatingly drive said curtain sprocket and guide sprocket concurrently at a constant speed of rotation, travel member means secured to said outer end of said curtain for travel therewith, said travel member engaging said guide roll throughout its travel such that said guide roll rotates in response to linear travel of said travel member means with said outer end, adjusting means adapted to store and release energy connected between said guide sprocket and said guide roll to accommodate a difference between turning forces developed by said guide sprocket driven at a constant speed of rotation and said guide shaft driven at a variable speed of rotation.

2. An assembly according to claim 1, wherein said adjusting means is adapted to store energy to accommodate said difference in a first direction of rotation of said guide roll and guide sprocket, and is adapted to release energy in a second direction of rotation of said guide roll and guide sprocket, said second direction being opposite to said first direction.

3. An assembly according to claim 2 wherein said adjusting means comprises a coiled spring surrounding said guide roll, said coiled spring having an inner end operably connected for rotation with said guide sprocket and an outer end operably connected for rotation with said guide roll.

4. A rolling door assembly comprising:

a door frame adapted to be disposed about a door opening, a door shaft mounted in an upper end of said door frame, a flexible curtain having an inner end and an outer end, said inner end being mounted on said door shaft, an idler roll in said door frame, said idler roll being adapted to engage an unrolled surface of said curtain, a drive loop member in operable engagement with said idler roll for loop travel during rotation of said idler roll, said outer end of said curtain being secured to said drive loop member such that said outer end and said drive loop member travel together, and an operating mechanism to wind and unwind said flexible curtain, comprising:

drive means for reversibly rotating said door shaft, an idler drive member floatingly supported about said idler shaft, said idler drive member being rotatably driven by said drive means concurrently with said door shaft, and a turning force accommodating member connected between said idler drive member and said idler shaft adapted to store and release energy.

5. A door assembly according to claim 4, wherein said turning force accommodating member is adapted to store excess energy developed from a difference between a constant speed rotation of said idler drive member and a diminishing speed of rotation of said idler roll resulting from a diminishing velocity of linear travel of said outer end of said curtain and of said drive loop member during unwinding; and to release such stored energy developed during unwinding of said curtain during winding of said curtain responsive to a difference between an increasing velocity of linear travel of said outer end of said roll door and of said drive loop member and a constant speed of rotation of said idler drive member.

6. A door assembly according to claim 5 wherein said turning force accommodating member comprises a spring member, said spring member being effective to drive said drive loop member to positively urge said outer end of said roll door during unwinding.

7. An assembly according to claim 1, wherein said travel member means comprises a pair of endless chains.

8. An assembly according to claim 7, wherein a chain of said pair is housed within each of said guide channels.

9. A rolling door mechanism comprising:

a roll door having a rotatable shaft upon which said door winds and unwinds;

motor means adapted to be operated at a constant speed for reversibly rotatably driving said shaft to wind up and unwind said door thereon;

track means for defining an essentially linear path of travel for the door when winding and unwinding;

idler shaft rotatably driven by the door at a variable speed related to the speed of linear movement of the door along said track means when driven by said motor means;

said idler shaft including an idler sprocket; drive means interconnecting said motor means, said roll door shaft and said idler sprocket; and energy storage means connected between the idler sprocket and the idler shaft to store and release energy according to the rotary speed difference therebetween.

10. A rolling door mechanism as defined in claim 9 wherein the energy storage means is a torsion spring.

* * * * *